United States Patent [19]

Vernon

[11] Patent Number: 4,845,870

[45] Date of Patent: Jul. 11, 1989

[54] FIREARM DISABLING APPARATUS

[76] Inventor: Terry M. Vernon, 407 E. Inwood Dr., Arlington, Tex. 76010

[21] Appl. No.: 92,651

[22] Filed: Sep. 3, 1987

[51] Int. Cl.[4] ..... F41C 17/00

[52] U.S. Cl. ..... 42/70.08; 42/66; 42/70.01

[58] Field of Search ..... 42/66, 70.01, 70.08, 42/70.11

[56] References Cited

U.S. PATENT DOCUMENTS

| | | | |
|---|---|---|---|
| 875,469 | 12/1907 | Tambour | 42/70.08 |
| 905,020 | 11/1908 | Tambour | 42/70.01 |
| 2,945,316 | 7/1960 | Mulno | 42/70.01 |
| 4,154,014 | 5/1979 | Smith | 42/70.01 |
| 4,672,763 | 6/1987 | Cunningham | 42/70.11 |
| 4,682,435 | 7/1987 | Heltzel | 42/70.01 |
| 4,730,537 | 3/1988 | Matzagg et al. | 42/70.08 |

*Primary Examiner*—Deborah L. Kyle
*Assistant Examiner*—Richard W. Wendtland
*Attorney, Agent, or Firm*—Arthur F. Zobal

[57] ABSTRACT

The apparatus of the invention is adapted to be used in a firearm of the type having a body having an interior space, a hammer supported for movement by the body, and a trigger for actuating the hammer. A strut member is located in the interior space of the body and has one end pivotally connected to the hammer. A movable bridge member, located in the interior space of the body, is coupled to the body for movement between first and second positions toward and away from the hammer respectively. The bridge member has an opening for freely receiving the opposite end of the strut member. A coiled spring is located around the strut member and has an end adapted to engage the structure of the strut member near its point of connection to the hammer and an opposite end adapted to engage the bridge member. An opening is formed through wall structure of the body in line with the bridge member. A movable keeper is provided which may be located through the opening for engaging the bridge member and moving it to its first position for containing the spring and allowing spring compression to occur against the hammer allowing it to fire the weapon when actuated by the trigger. A releasable means is provided for releasably holding the keeper in its enabling position. When the releasable means is released, the keeper is allowed to be moved away from its enabling position to allow the bridge member to move to its second position for releasing spring compression to disable the firearm.

6 Claims, 2 Drawing Sheets

FIREARM DISABLING APPARATUS

BACKGROUND OF THE INVENTION

There is a well-recognized need for safer operating mechanisms on firearms, such as pistols, revolvers, rifles, shotguns, etc. The attempts to solve the various problems involved seem to begin from the point of view that all firearms normally are to remain "armed and in a state of readiness" at all times. Safety features are viewed as "add/ons" and come into play only when activated by the user.

A need exists for a mechanism for maintaining a firearm in a neutral or disengaged state until actually needed at which time the firing assembly then can be made to function easily and quickly.

U.S. Pat. Nos. 875,469; 905,020; 2,945,316; 4,067,132; 4,135,320; 4,154,014; and 4,672,763 disclose different types of safety devices for firearms. The latter patent discloses a firearm that can be made to function from a disengaged state only by removing the cover from the handle and reassemblying the interior components which is time consuming.

SUMMARY OF THE INVENTION

It is an object of the invention to provide a mechanism for maintaining a firearm in a neutral or disengaged state until actually needed, at which time the firing assembly then can be made to function easily and quickly. After use, the firing assembly can once again be quickly disengaged until needed again.

The invention may be employed in newly manufactured firearms or may be retrofitted to an existing firearm. Also, it may be employed in addition to safety mechanisms presently existing on firearms.

The invention may be employed in a firearm of the type having a body with an interior space, a hammer supported for movement by the body, and a trigger for actuating the hammer. The invention comprises a strut member located in the interior space of the body with one end pivotally connected to the hammer. A moveable bridge member also is located in the interior space of said hollow structure. The bridge member is connected to interior structure of the body for movement between first and second positions toward and away from the hammer respectively. The bridge member has an opening for freely receiving the other end of the strut member whereby the strut member and the bridge member may move relative to each other. A coiled spring is located around said strut member and has a first end adapted to engage structure of the strut member near its point of connection with the hammer and a second end adapted to engage the bridge member. An opening is formed through the structure of the body in line with the bridge member. A keeper means is provided which is moveable through the opening for engaging the bridge member and moving it to said first position for allowing sufficient spring compression to occur such that the hammer will fire the firearm when actuated by the trigger. A releasable means is provided for releaseably holding the keeper means in said opening. The releasable means, when released, allows said keeper means to be moved away from its enabling position to allow the bridge member to move to its second position for releasing spring compression for disabling the firearm.

DESCRIPTION OF THE PREFERRED EMBODIMENTS

Figure 1:
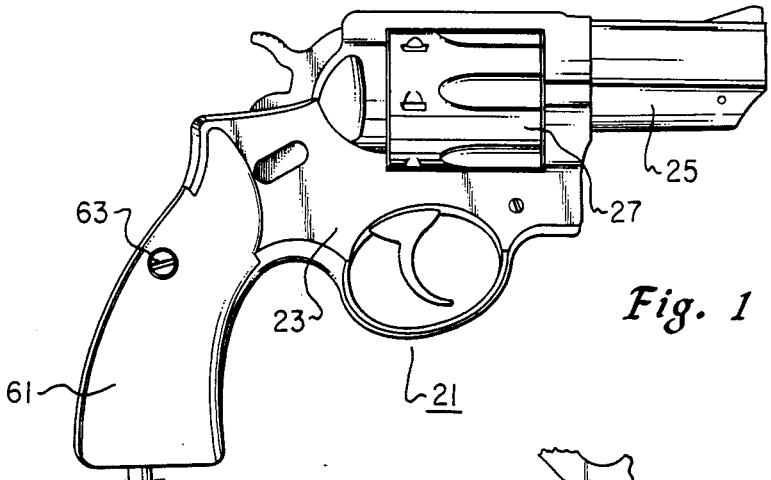
FIG. 1 is a side view of a revolver employing the invention.
Figure 2:
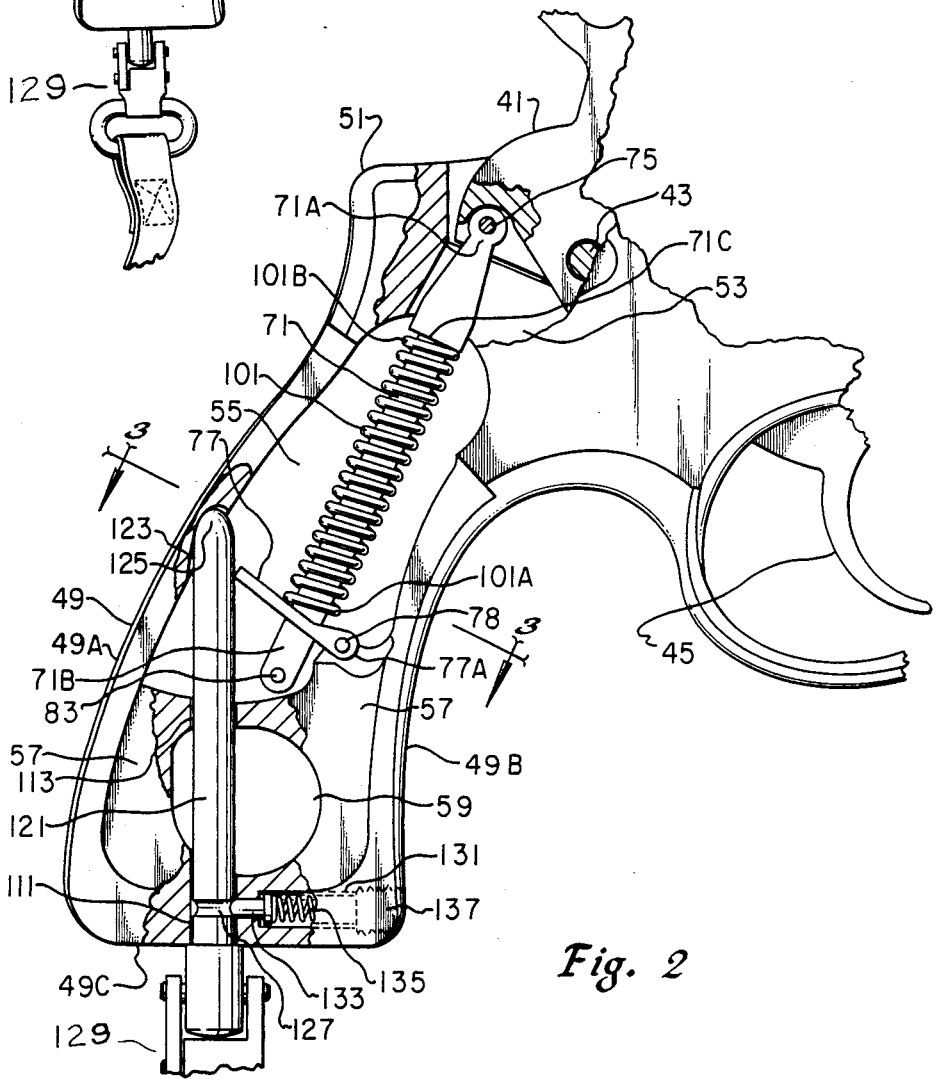
FIG. 2 is a partial cross-sectional view of a revolver illustrating the invention activated to place the revolver in an enabled state.
Figure 4:
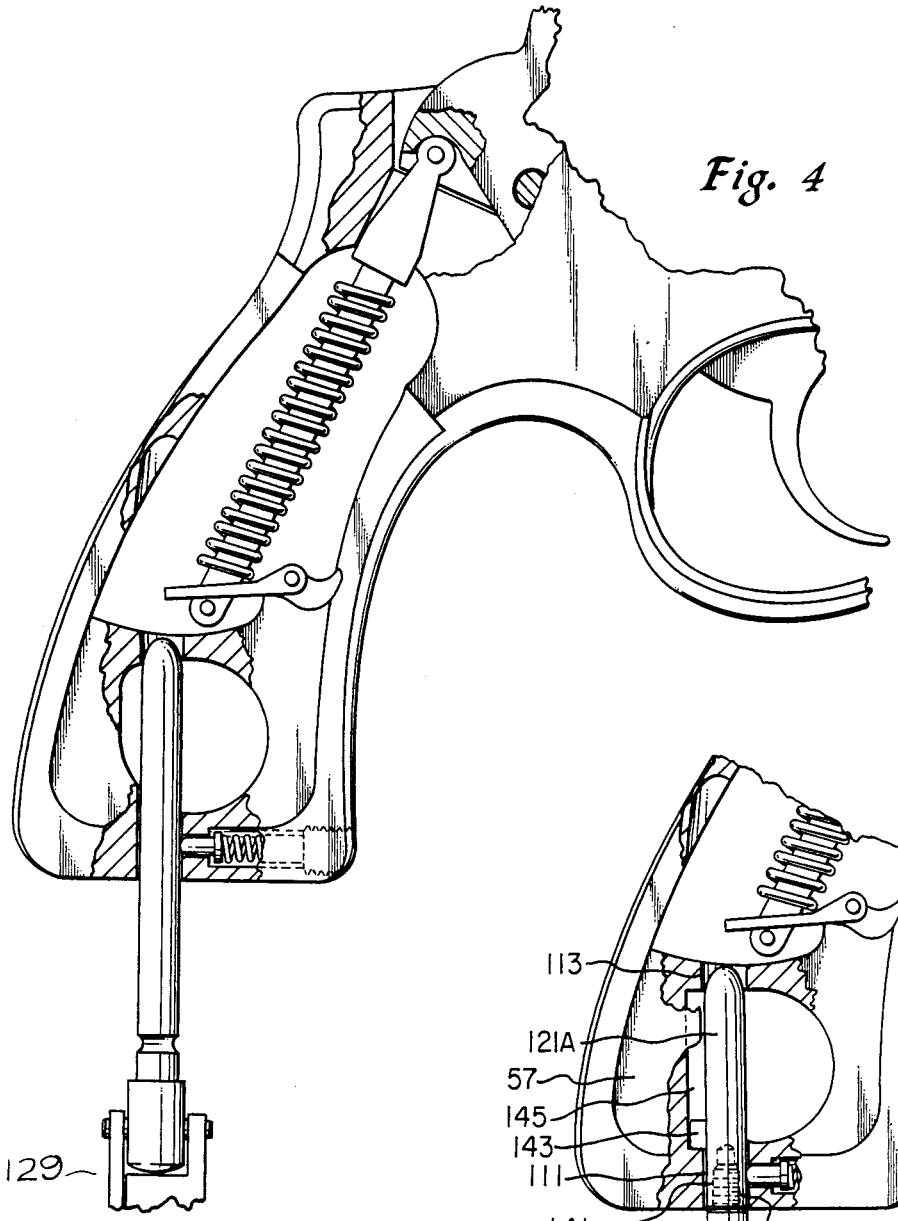
FIG. 4 is a partial cross-section of the revolver of FIG. 2 illustrating the invention deactivated to place the revolver in a disabled state.

Referring now to the drawings, there is illustrated a revolver 21 employing the invention. The revolver 21 comprises a body 23 which supports a barrel 25 and a cylinder 27. A hammer 41 is pivotally coupled to the body by a pin 43. In FIGS. 1, 2, and 4, the hammer 41 is shown in its rest position. The body 23 also supports a trigger 45 for actuating the hammer 41 for firing the revolver. When the trigger 45 is pulled, the hammer 41 is pivoted backward and then released to fire the revolver 21.

The body 23 includes a handle 49. The body 23 comprises wall structure 51 which is hollow such that a hollow or interior space is provided at 53 which extends downward into the handle 49 at 55. The handle 49 has lower transverse cross support structure 57 extending between edges 49A and 49B. Lower hollow interior space is provided at 59. Two covers 61 are removably secured to opposite sides of the handle 49 by a bolt 63 and nut, not shown. The bolt 63 is inserted through an aperture formed through one of the covers 61, through the interior space 55, through an aperture formed through the other cover 61 and is screwed into the nut on the other side of the other cover 61.

A strut member 71 has one end 71A pivotally connected to the hammer 41 by a pin 75. A bridge member 77 has one end 77A pivotally connected by a pin 78 to the interior structure 57 of the handle 49 near its edge 49B. The bridge member 77 extends into the interior space 55 of the handle 49 and has an aperture 79 formed therethrough for freely and slideably receiving the other end 71B of the strut member 71. A pin 83 extends through the lower end 71B of the strut member and outward from opposite sides thereof below the bridge member 77 for preventing passage of the strut member 71 back through the aperture 79 of the bridge member 77. The bridge member 77 may be pivoted between a first or enabling position, as shown in FIG. 2, and a second or released position, as shown in FIG. 4.

A helical coiled spring 101 is located around the strut member 71 and has one end 101A adapted to engage the top side of the bridge member 77 and an opposite end 101B adapted to engage a shoulder 71C formed on the strut member 71 near its end 71A when the assembly is in the engaged position, as shown in FIG. 2. The inside diameter of the coil 101 is sufficient to allow it to freely slide along the length of the strut member 71 between the bridge member 77 and the shoulder 71C when the bridge member 77 is in its released position, as shown in FIG. 4. When the bridge member 77 is moved to its enabling position, as shown in FIG. 2, the spring 101 is compressed and contained securely between the bridge member 77 and the strut shoulder 71C applying sufficient pressure or tension against the hammer 41 thereby placing the revolver in an enabled state. In this state, when the trigger 45 is pulled, the hammer 41 is caused to move forward by the force created by the compressed spring for firing the revolver. When the bridge member 77 is moved to its released position, as shown in FIG. 4, the pressure on the spring 101 is released thereby placing the revolver in a disengaged state. In this state, when the trigger 45 is pulled, the spring 101 cannot cause the hammer to pivot forward whereby the revolver cannot be fired because no spring compression can occur due to the relative positions of the parts.

The pivotal connection of the strut member 71 to the hammer 41 by the pin 75 and the size of the aperture 79 formed in the bridge member 77 allow the strut member to pivot freely about the pin 75 so as to allow the strut member to adjust to the constantly changing positions and relative angles created as the hammer 41 is pivoted forward and/or rearward during operation. The strut member 77 remains connected to the hammer 41 at all times whether in operation or in a "neutral" position.

Aligned apertures 111 and 113 are formed through the lower edge 49C of the handle and through the transverse support structure 57 for slideably receiving a keeper member 121. The aperture 111 and 113 also are in alignment with the free end of the bridge member 77 when in its released position, as shown in FIG. 4, and with another aperture 123 formed in the inner edge 49A of the handle. The keeper member 121 has a rounded end 125 and an annular groove 127 formed around its other end which also has a grip member 129 connected thereto. The keeper member 121 can be moved from a position out of engagement with the bridge member 77, as shown in FIG. 4, to a position whereby it engages the lower side of the bridge member 77 and moves it upward to an enabling position, as shown in FIG. 2. When the keeper member 121 and bridge member 77 are in their enabling positions, as shown in FIG. 2, the spring 101 is contained sufficiently to allow sufficient spring compression to occur such that the hammer will fire the revolver when the trigger 45 is pulled.

When the keeper 121 is in its enabling position, its groove 127 is in alignment with an aperture 131 formed through the lower edge 49B of the handle 49 and a detent member 133 biased by a spring 135 releasably engages the groove 127 and holds the keeper 121 in this position. The spring 135 is held in place by a set screw 137 screwed into the outer threaded end of the aperture 131. When the user desires to place the revolver in a disengaged state, he can readily pull the keeper member 121 out of the handle 49 which releases the compression on the spring whereby the revolver can not fire when the trigger is pulled. The user can place the keeper 121 in his pocket or in a designated safe place. In the "neutral" position, the strut member 71 remains pivotally connected to the hammer 41 and the bridge member 77 remains pivotally connected to the inside structure of the handle with the spring 101 surrounding the strut member 71. The strut member 71 is prevented by the pin 83 from being removed from the bridge member 77. Thus, the revolver can be readily placed in the enabled state without the necessity of removing the covers 61 from the handle by simply inserting the keeper member 121 into the handle through the apertures 111 and 113 and moving it against the bridge member until the end 125 of the keeper 121 is located in the aperture 123 and the detent 121 engages the groove 127 thereby placing the bridge member 77 in its enabling position to allow compression of the spring 101 to occur enabling the revolver to be fired by pulling the trigger 45.

In the alternative, the bridge member 77 may be constructed of a leaf/spring design that is formed in an open "L" shape. One end of the leaf/spring will be connected to the interior structure 57, either by a spot weld or slipped into a slot or pocket in the frame support structure 57. The bend in the leaf/spring will be functionally located similar to the pivot pin 78. The other end of the leaf/spring will extend into the interior space 55 and have an aperture for freely receiving the end of the strut member 71 as described in connection with the bridge member 77. Constructed of the desired tensile strength, this configuration allows the one-piece bridge member itself to work like a "spring" board when the keeper 121 is inserted into the apertures 111 and 113 and moved inward to move the bridge member to its enabling position to allow sufficient compression of the spring 101 to occur for firing the firearm when the trigger 45 is pulled. When the keeper 121 is removed from the revolver, the leaf/spring will move to its released position similar to that shown of the bridge member in FIG. 4. This modification eliminates the requirement for a separate hinge or pin 78.

Figure 5:
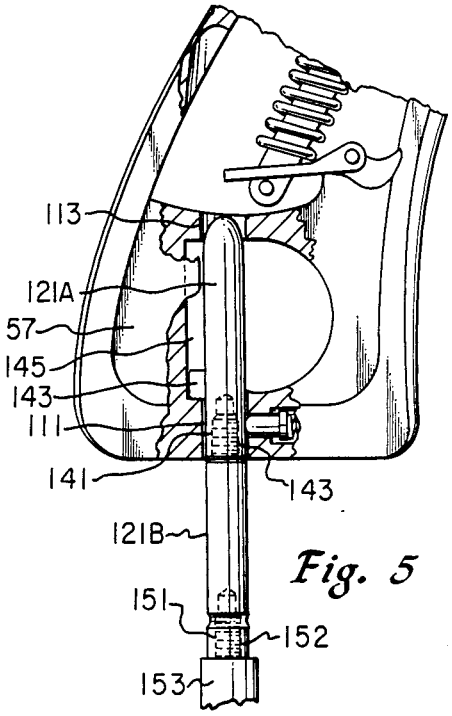
FIG. 5 illustrates a modification of the keeper of the invention.
Figure 3:
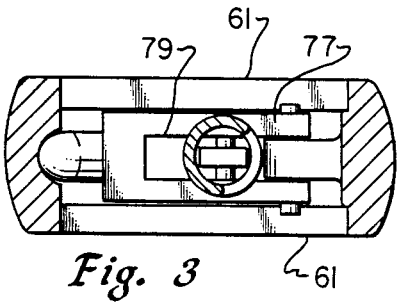
FIG. 3 is a cross-section of FIG. 2 taken along the lines 3—3 thereof.

Referring to FIG. 5, the keeper 121 is modified to be formed into two parts, an interior portion 121A and a lower portion 121B which can be coupled to and uncoupled from the interior portion 121A. Interior portion 121A has a threaded aperture 141 formed in its lower end and the lower portion 121B has a threaded end 143 adapted to be screwed into the aperture 141 and to be removed therefrom. A key 143 is attached to one side of the interior member 121A which is slideable in a slot 145 formed in the interior structure 57. The key 143 and slot 145 maintain the interior member 121A in the same angular position but allow it to move toward and away from the bridge member 77. The combined keeper 121A and 121B act in the same manner as the keeper 121 to engage the brige member 77 and move it upward to compress the spring as described previously. The keeper 121A and 121B can be moved to a position out of engagement with the bridge member 77 to place the firearm in a disabled position. In this position, the lower removable portion 121B can be uncoupled from the interior portion 121A and placed in the user's pocket, etc. The interior portion 21A however will remain in the interior of the firearm and is prevented from passing through the aperture 113 by the key 143.

The lower portion 121B of the keeper may also have a threaded aperture 151 formed in its lower end for receiving the threaded end 152 of a grip member 153 which may be unscrewed from the lower portion 121B when the keeper 121A and 121B is in its enabling position to minimize protuberance of the keeper from the firearm.

In the preferred embodiment, the detent 127 will make an audible "click" when it enters the groove 127 as the keeper 121, or 121A and 121B is moved into the compressing position, thus allowing the user to hear a "clicking" noise indicating that the firing system is engaged and functional.

Although the invention was described as being employed in a revolver, it is to be understood that it could be employed in many types of pistols, rifles, shotguns, etc. In the preferred embodiment, the keeper 121, or 121A and 121B is inserted through the hand grip butt, however, it also could be inserted through the top side of certain types of firearms or even through the butt plate of a rifle stock.

The overall length of the keeper 121, or 121A and 121B depends upon the distance from the external point of insertion up to the point where the keeper is totally inserted plus the length of the external portion of the keeper which remains protruding from the firearm after the keeper has been fully inserted. The length of the keeper would allow for the thickness of any overlay that the keeper may also pass through, i.e. pistol grips, rifle stocks, etc.

As an alternative, the overall length of the keeper 121, or 121A and 121B, may be of a length that does not protrude from the firearm even when fully inserted to its enabling position but rather remains flush with the normal external body covers or remains somewhat recessed within an aperture in the housing cover. This design results in the keeper 121 not interfering with the user's normal grip. While using the firearm, the cosmetic profile and appearance of the firearm is not altered while still allowing for quick access to the keeper so the firearm may be easily disabled.

I claim:

1. An apparatus for preventing unauthorized firing of a firearm, comprising:

a body having wall structure and an interior space, a hammer supported for movement by said body, a trigger for actuating said hammer, a strut member having first and second ends located in the interior space of said body, means for pivotally connecting said first end of said strut member to said hammer, a moveable bridge member located in the interior space of said body, said bridge member being connected to the interior structure of said body for movement between first and second positions toward and away from said hammer respectively, said bridge member having an opening for freely receiving said second end of said strut member whereby said strut member and said bridge member may move relative to each other, a coiled spring located around said strut member and having a first end adapted to engage structure of said strut member near its first end and a second end adapted to engage said bridge member whereby when said bridge member is moved to said first position, sufficient spring compression is allowed to occur such that the hammer will fire the firearm when actuated by said trigger and when said bridge member is moved to said second position, spring compression is released to disable the firearm, an opening formed through wall structure of said body, a keeper means moveable through said opening for engaging said bridge member and moving it to said first position, releasable means for releasably holding said keeper means at an enabling position in said opening where it holds said bridge member in its first position, said releasable means when released allowing said keeper means to be moved away from said enabling position to allow said bridge member to move to its second position for releasing spring compression to disable the firearm.

2. The apparatus of claim 1, wherein:

said body comprises a handle having an interior space, said bridge member, said spring, and at least said second end of said strut member are located in the interior space of said handle, at least one cover for providing excess to the interior space of said handle, means for releasably mounting said one cover to said handle, said keeper means being moveable to and away from its enabling position for enabling and disabling the firearm respectively without removing said cover.

3. The apparatus of claim 1, comprising:

means for pivotally connecting said bridge member to said interior structure of said body.

4. The apparatus of claim 2, comprising:

means for pivotally connecting said bridge member to interior structure of said handle.

5. The apparatus of claim 1, wherein:

said keeper means comprises:

an interior portion and a removable portion, said interior portion having an engaging end for engaging said bridge member and moving it to its first position and a second end with coupling means, said removable portion having coupling means at an end whereby it may be removably coupled to said second end of said interior portion for moving said engaging end of said interior portion to said enabling position and uncoupled from said second end of said interior portion when said interior portion is moved away from said bridge member, and means coupled to said interior portion for preventing said interior portion from passing through said opening.

6. The safety device of claim 2, wherein:

said keeper means comprises:

an interior portion and a removable portion, said interior portion having an engaging end for engaging said bridge member and moving it to its first position and a second end with coupling means, said removable portion having coupling means at an end whereby it may be removably coupled to said second end of said interior portion for moving said engaging end of said interior portion to said enabling position and uncoupled from said second end of said interior portion when said interior portion is moved away from said bridge member, and means coupled to said interior portion for preventing said interior portion from passing through said opening.

* * * * *